US011295669B2

(12) United States Patent
Wang et al.

(10) Patent No.: US 11,295,669 B2
(45) Date of Patent: Apr. 5, 2022

(54) PIXEL CIRCUIT AND METHOD FOR IMPROVING IMAGE QUALITY AT LOW DRIVING FREQUENCY

(71) Applicant: Samsung Display Co., Ltd., Yongin-Si (KR)

(72) Inventors: Seong Min Wang, Seongnam-si (KR); Jihye Kong, Seongnam-si (KR); Yongho Yang, Suwon-si (KR); Jeong-Soo Lee, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/164,657

(22) Filed: Feb. 1, 2021

(65) Prior Publication Data

US 2021/0287605 A1 Sep. 16, 2021

(30) Foreign Application Priority Data

Mar. 10, 2020 (KR) ..... 10-2020-0029483

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/2092* (2013.01); *G09G 3/3266* (2013.01); *G09G 3/3291* (2013.01); *G09G 2300/0842* (2013.01)

(58) Field of Classification Search
CPC .. G09G 3/3233; G09G 3/2092; G09G 3/3266; G09G 3/3291; G09G 2300/0842;
(Continued)

(56) References Cited

U.S. PATENT DOCUMENTS 9,824,632 B2 11/2017 Chaji et al.
2010/0013816 A1 1/2010 Kwak
(Continued)

FOREIGN PATENT DOCUMENTS

CN 109256094 A 1/2019
EP 3680889 A1 7/2020
(Continued)

*Primary Examiner* — Premal R Patel
(74) *Attorney, Agent, or Firm* — Innovation Counsel LLP

(57) ABSTRACT

A pixel circuit includes a light-emitting element, a first transistor, a second transistor operating based on a first gate signal, a third transistor operating based on a second gate signal, a fourth transistor operating based on an initialization control signal, a fifth transistor operating based on an emission control signal, a sixth transistor operating based on the emission control signal, a seventh transistor, of which one terminal is connected to the light-emitting element, operating based on a bias control signal, an eighth transistor, of which one terminal is connected to the driving transistor, operating based on the bias control signal, a storage capacitor, and the light-emitting element. The pixel circuit performs a display-scan operation in a first case where a driving time of a panel driving frame is a minimum driving time and performs a display-scan operation and at least one self-scan operation in a second case where the driving time is different from the minimum driving time.

20 Claims, 9 Drawing Sheets

(51) Int. Cl.
*G09G 3/3266* (2016.01)
*G09G 3/3291* (2016.01)

(58) Field of Classification Search
CPC ... G09G 2300/0819; G09G 2300/0852; G09G 2300/0861; G09G 2310/0256; G09G 2320/0238; G09G 2320/0247; G09G 2340/0435; G09G 3/3258; G09G 2300/0439
See application file for complete search history.

(56) References Cited

U.S. PATENT DOCUMENTS

| | | | | |
|---|---|---|---|---|
| 2015/0287362 | A1 | 10/2015 | Lee et al. | |
| 2016/0118420 | A1* | 4/2016 | Yang | H01L 27/124 257/40 |
| 2017/0117343 | A1* | 4/2017 | Oh | H01L 27/3262 |
| 2017/0330927 | A1* | 11/2017 | Lee | G09G 3/3266 |
| 2018/0151123 | A1 | 5/2018 | Li et al. | |
| 2021/0074213 | A1 | 3/2021 | Huang et al. | |

FOREIGN PATENT DOCUMENTS

| | | | |
|---|---|---|---|
| KR | 10-0560780 | B1 | 3/2006 |
| KR | 10-2014-0013586 | A | 2/2014 |
| KR | 10-2016-0052844 | A | 5/2016 |
| KR | 10-2017-0049787 | A | 5/2017 |
| KR | 10-2020-0142646 | A | 12/2020 |

* cited by examiner

PIXEL CIRCUIT AND METHOD FOR IMPROVING IMAGE QUALITY AT LOW DRIVING FREQUENCY

CROSS-REFERENCE TO RELATED APPLICATION

This application claims priority under 35 USC § 119 to Korean Patent Application No. 10-2020-0029483 filed on Mar. 10, 2020 in the Korean Intellectual Property Office (KIPO), the disclosure of which is incorporated herein by reference in its entirety.

BACKGROUND

1. Field

The present disclosure relates generally to a display device. More particularly, the present disclosure relates to a pixel circuit included in a display device (e.g., an organic light emitting display device) that is capable of changing a driving frequency of a display panel and a driving time of a panel driving frame.

2. Description of the Related Art

Generally, a display device includes a source device and a sink device. The source device (e.g., a graphic processing unit (GPU)) transmits image data to the sink device that performs a displaying operation based on the image data received from the source device. According to characteristics of an image displayed, the display device may change a frame rate (or a driving time) of an image frame while the sink device performs the displaying operation. However, if a frame rate of a panel driving frame for the displaying operation is not changed according to the frame rate, the frame rate of the image frame (e.g., a GPU rendering speed) may become inconsistent with the frame rate of the panel driving frame, causing a tearing phenomenon (e.g., the image is cut off), a stuttering phenomenon (e.g., the image is delayed), and the like on the image that the sink device displays. In order to resolve these problems, a technology may be adopted to change the frame rate of the panel driving frame by increasing or decreasing a vertical blank period of the panel driving frame according to the varying frame rate of the image frame. However, in a case where the driving time of the panel driving frame is increased when the frame rate of the panel driving frame is decreased (i.e., when the driving frequency of the display panel is decreased), characteristics of a driving transistor included in a pixel circuit of the display panel may be fixed in a specific state during the panel driving frame, and it can cause a flicker due to hysteresis characteristics. In particular, the flicker can be prominent in a low gray-level image. Thus, the display panel that operates at a low driving frequency may exhibit a degraded quality of the image.

SUMMARY

Some embodiments of the present disclosure provide a pixel circuit that can prevent a phenomenon such as a flicker that may occur on a display panel due to hysteresis characteristics of a driving transistor that may be fixed in a specific state during a panel driving frame by performing a display-scan operation in a first case where a driving time of the panel driving frame is a minimum driving time and by performing a display-scan operation and at least one self-scan operation in a second case where the driving time of the panel driving frame is different from the minimum driving time.

According to an embodiment, a pixel circuit may include: a first transistor including a first terminal connected to a first node, a gate terminal connected to a second node, and a second terminal connected to a third node; a second transistor including a first terminal connected to a data line, a second terminal connected to the first node, and a gate terminal that receives a first gate signal; a third transistor including a first terminal connected to the third node, a second terminal connected to the second node, and a gate terminal that receives a second gate signal; a fourth transistor including a first terminal connected to the second node, a second terminal that receives a first initialization voltage, and a gate terminal that receives an initialization control signal; a fifth transistor including a first terminal that receives a first power voltage, a second terminal connected to the first node, and a gate terminal that receives an emission control signal; a sixth transistor including a first terminal connected to the third node, a second terminal connected to a fourth node, and a gate terminal that receives the emission control signal; a seventh transistor including a first terminal connected to the fourth node, a second terminal that receives a second initialization voltage, and a gate terminal that receives a bias control signal; an eighth transistor including a first terminal connected to the third node, a second terminal that receives a bias voltage, and a gate terminal that receives the bias control signal; a storage capacitor including a first terminal that receives the first power voltage and a second terminal connected to the second node; and a light emitting element including a first terminal connected to the fourth node and a second terminal that receives a second power voltage lower than the first power voltage. The pixel circuit may perform a display-scan operation in a first case where a driving time of a panel driving frame is a minimum driving time and may perform a display-scan operation and at least one self-scan operation in a second case where the driving time of the panel driving frame is different from the minimum driving time.

In an embodiment, when the pixel circuit performs the display-scan operation, each of the first gate signal, the second gate signal, the initialization control signal, the bias control signal, and the emission control signal may include at least one turn-on voltage period.

In an embodiment, the at least one turn-on voltage period of the initialization control signal, the at least one turn-on voltage period of the first gate signal, the at least one turn-on voltage period of the second gate signal, and the at least one turn-on voltage period of the bias control signal may be positioned in a turn-off voltage period of the emission control signal.

In an embodiment, the at least one turn-on voltage period of the bias control signal may be positioned after the at least one turn-on voltage period of the second gate signal.

In an embodiment, the at least one turn-on voltage period of the bias control signal may include a first turn-on voltage period positioned before the at least one turn-on voltage period of the initialization control signal and a second turn-on voltage period positioned after the at least one turn-on voltage period of the second gate signal.

In an embodiment, when the pixel circuit performs the self-scan operation, each of the bias control signal and the emission control signal may include at least one turn-on voltage period, and each of the first gate signal, the second gate signal, and the initialization control signal may be turned off.

In an embodiment, the at least one turn-on voltage period of the bias control signal may be positioned in a turn-off voltage period of the emission control signal.

In an embodiment, the at least one turn-on voltage period of the bias control signal may include a first turn-on voltage period and a second turn-on voltage period that are temporally spaced apart from each other in a turn-off voltage period of the emission control signal.

In an embodiment, the bias voltage and the second initialization voltage may be changed based on the driving time of the panel driving frame.

In an embodiment, the pixel circuit may further include a boost capacitor including a first terminal connected to the second node and a second terminal connected to the gate terminal of the third transistor.

According to an embodiment, a pixel circuit may include: a first transistor including a first terminal connected to a first node, a gate terminal connected to a second node, and a second terminal connected to a third node; a second transistor including a first terminal connected to a data line, a second terminal connected to the first node, and a gate terminal that receives a first gate signal; a third transistor including a first terminal connected to the third node, a second terminal connected to the second node, and a gate terminal that receives a second gate signal; a fourth transistor including a first terminal connected to the second node, a second terminal that receives a first initialization voltage, and a gate terminal that receives an initialization control signal; a fifth transistor including a first terminal that receives a first power voltage, a second terminal connected to the first node, and a gate terminal that receives an emission control signal; a sixth transistor including a first terminal connected to the third node, a second terminal connected to a fourth node, and a gate terminal that receives the emission control signal; a seventh transistor including a first terminal connected to the fourth node, a second terminal that receives a second initialization voltage, and a gate terminal that receives a bias control signal; an eighth transistor including a first terminal connected to the first node, a second terminal that receives a bias voltage, and a gate terminal that receives the bias control signal; a storage capacitor including a first terminal that receives the first power voltage and a second terminal connected to the second node; and a light emitting element including a first terminal connected to the fourth node and a second terminal that receives a second power voltage lower than the first power voltage. The pixel circuit may perform a display-scan operation in a first case where a driving time of a panel driving frame is a minimum driving time and may perform a display-scan operation and at least one self-scan operation in a second case where the driving time of the panel driving frame is different from the minimum driving time.

In an embodiment, when the pixel circuit performs the display-scan operation, each of the first gate signal, the second gate signal, the initialization control signal, the bias control signal, and the emission control signal may include at least one turn-on voltage period.

In an embodiment, the at least one turn-on voltage period of the initialization control signal, the at least one turn-on voltage period of the first gate signal, the at least one turn-on voltage period of the second gate signal, and the at least one turn-on voltage period of the bias control signal may be positioned in a turn-off voltage period of the emission control signal.

In an embodiment, the at least one turn-on voltage period of the bias control signal may be positioned after the at least one turn-on voltage period of the second gate signal.

In an embodiment, the at least one turn-on voltage period of the bias control signal may include a first turn-on voltage period positioned before the at least one turn-on voltage period of the initialization control signal and a second turn-on voltage period after the at least one turn-on voltage period of the second gate signal.

In an embodiment, when the pixel circuit performs the self-scan operation, each of the bias control signal and the emission control signal may include at least one turn-on voltage period, and each of the first gate signal, the second gate signal, and the initialization control signal may be turned off.

In an embodiment, the at least one turn-on voltage period of the bias control signal may be positioned in a turn-off voltage period of the emission control signal.

In an embodiment, the at least one turn-on voltage period of the bias control signal may include a first turn-on voltage period and a second turn-on voltage period that are temporally spaced apart from each other in a turn-off voltage period of the emission control signal.

In an embodiment, the bias voltage and the second initialization voltage may be changed based on the driving time of the panel driving frame.

In an embodiment, the pixel circuit may further include a boost capacitor including a first terminal connected to the second node and a second terminal connected to the gate terminal of the third transistor.

The pixel circuit may prevent a phenomenon such as a flicker that may occur on a display panel due to hysteresis characteristics of a driving transistor that may be fixed in a specific state during a panel driving frame by performing a display-scan operation and at least one self-scan operation in a case where the driving time of the panel driving frame is different from the minimum driving time. As a result, the display device including the pixel circuit may provide a high-quality image to a viewer even when the display panel operates at a low driving frequency. However, it is understood that the present inventive concept are not limited thereto. Thus, the present inventive concept may be extended without departing from the spirit and the scope of the present disclosure.

BRIEF DESCRIPTION OF THE DRAWINGS

Illustrative, non-limiting embodiments of the present disclosure will be more clearly understood from the following detailed description in conjunction with the accompanying drawings.

DETAILED DESCRIPTION OF THE EMBODIMENTS

Hereinafter, exemplary embodiments of the present disclosure will be explained in detail with reference to the accompanying drawings.

Figure 1:
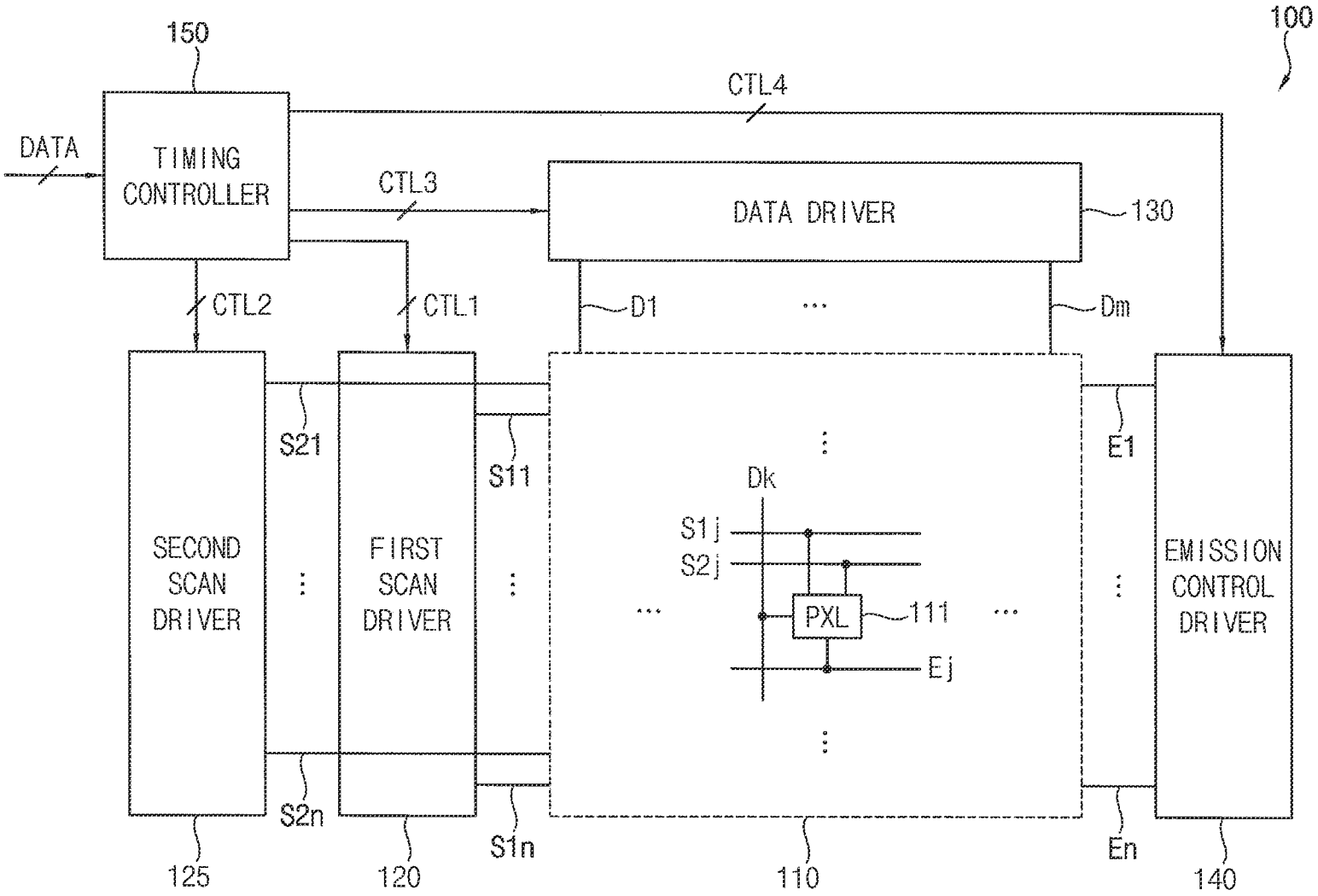
FIG. 1 is a block diagram illustrating a display device according to an embodiment.
Figure 2:
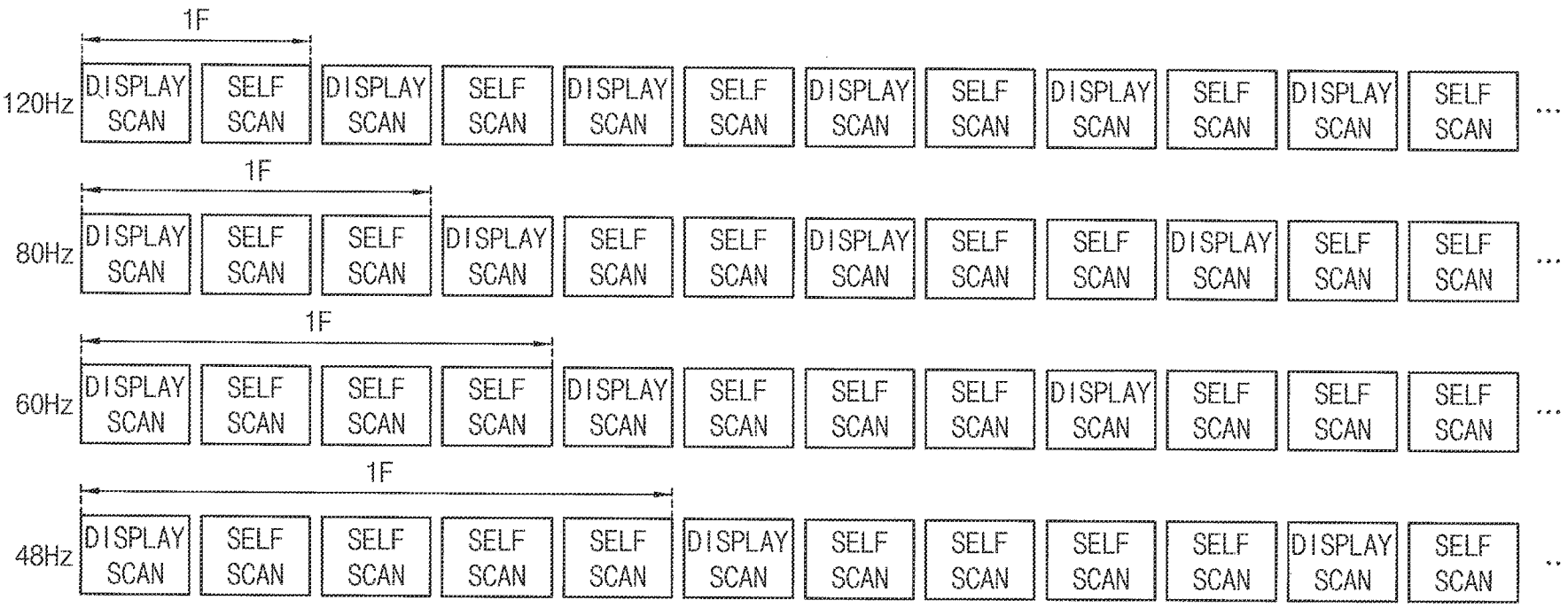
FIG. 2 is a conceptual diagram for describing an operation of the display device of FIG. 1.
Figure 3:
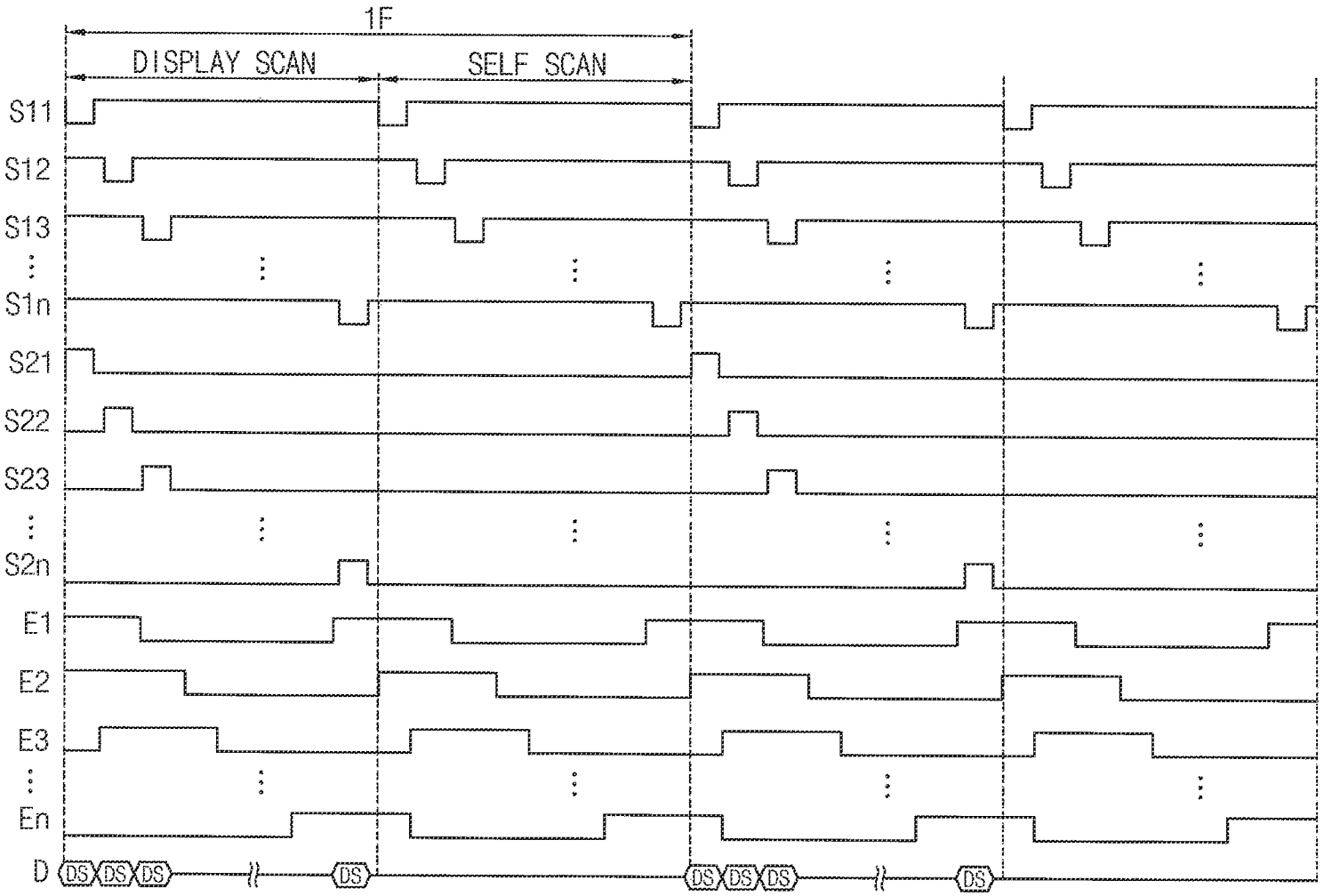
FIG. 3 is a timing diagram illustrating an example in which the display device of FIG. 1 operates at a first driving frequency.
Figure 4:
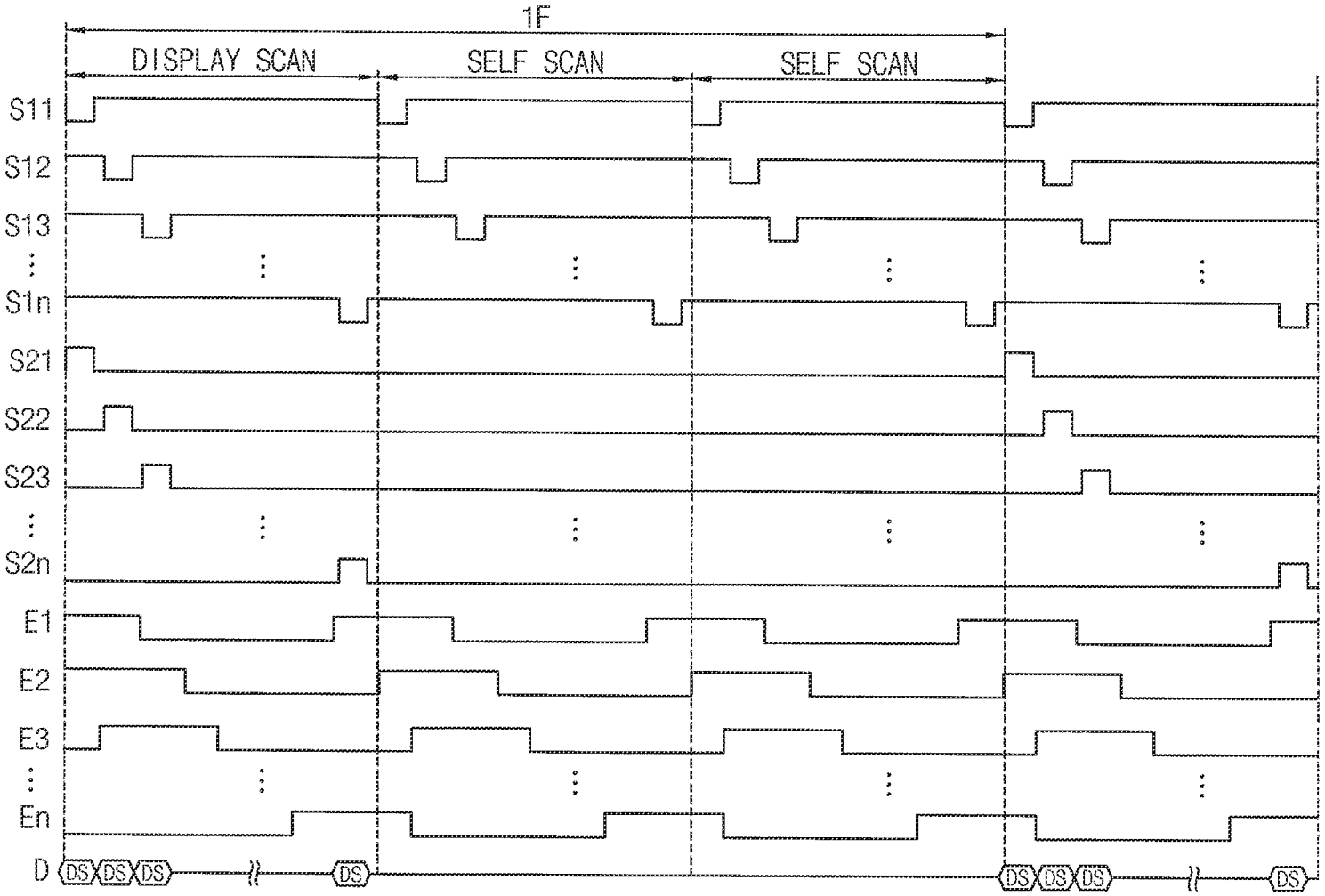
FIG. 4 is a timing diagram illustrating an example in which the display device of FIG. 1 operates at a second driving frequency.

FIG. 1 is a block diagram illustrating a display device according to an embodiment, FIG. 2 is a conceptual diagram for describing an operation of the display device of FIG. 1, FIG. 3 is a timing diagram illustrating an example in which the display device of FIG. 1 operates at a first driving frequency, and FIG. 4 is a timing diagram illustrating an example in which the display device of FIG. 1 operates at a second driving frequency.

Referring to FIGS. 1 to 4, a display device 100 may include a display panel 110, a first scan driver 120, a second scan driver 125, a data driver 130, an emission control driver 140, and a timing controller 150. The display device 100 may display an image on the display panel 110 at various driving frequencies according to driving conditions and/or modes of operation. For example, the display device 100 may display an image at a driving frequency between 1 Hz and 120 Hz (i.e., a frame rate of a panel driving frame may be between 1 Hz and 120 Hz). Examples of the display device 100 include, but are not limited to, an organic light emitting display device and a quantum-dot light emitting display device. However, the display device 100 is not limited thereto these examples.

The display panel 110 may include a plurality of pixel circuits 111. For example, the pixel circuits 111 may include a red pixel circuit, a green pixel circuit, and a blue pixel circuit. Here, each of the pixel circuits 111 may be connected to a first scan line S1*j* that transfers a bias control signal EB, where j is an integer between 1 and n, a second scan line S2*j* that transfers a first gate signal GW, a second gate signal GC, and an initialization control signal GI, a data line Dk that transfers a data signal DS, where k is an integer between 1 and m, and an emission control line Ej that transfers an emission control signal EM. For convenience of description, although each of the second scan lines S21~S2*n* is illustrated as one line in FIG. 1, it should be understood that each of the second scan lines S21~S2*n* can include a first line that transfers the first gate signal GW, a second line that transfers the second gate signal GC, and a third line that transfers the initialization control signal GI or that a signal applied to one pixel row (e.g., the first gate signal GW) via each of the second scan lines S21~S2*n* can be applied to other pixel rows (e.g., the second gate signal GC or the initialization control signal GI). In an embodiment, each of the pixel circuits 111 may perform one display-scan operation. A display-scan operation may refer to an operation that receives the data signal DS to emit light using the light emitting element, when the driving time of the panel driving frame is a minimum driving time. In addition, each of the pixel circuits 111 may perform one display-scan operation and at least one self-scan operation. A self-scan operation may refer to an operation that changes characteristics of a driving transistor, when the driving time of the panel driving frame is not the minimum driving time.

In an embodiment, each of the pixel circuits 111 may include a first transistor including a first terminal connected to a first node, a gate terminal connected to a second node, and a second terminal connected to a third node; a second transistor including a first terminal connected to the data line Dk, a second terminal connected to the first node, and a gate terminal that receives the first gate signal GW; a third transistor including a first terminal connected to the third node, a second terminal connected to the second node, and a gate terminal that receives the second gate signal GC; a fourth transistor including a first terminal connected to the second node, a second terminal that receives a first initialization voltage, and a gate terminal that receives the initialization control signal GI; a fifth transistor including a first terminal that receives a first power voltage, a second terminal connected to the first node, and a gate terminal that receives the emission control signal EM; a sixth transistor including a first terminal connected to the third node, a second terminal connected to a fourth node, and a gate terminal that receives the emission control signal EM; a seventh transistor including a first terminal connected to the fourth node, a second terminal that receives a second initialization voltage, and a gate terminal that receives the bias control signal EB; an eighth transistor including a first terminal connected to the third node, a second terminal that receives a bias voltage, and a gate terminal that receives the bias control signal EB; a storage capacitor including a first terminal that receives the first power voltage and a second terminal connected to the second node; and a light emitting element including a first terminal connected to the fourth node and a second terminal that receives a second power voltage lower than the first power voltage. This embodiment of the pixel circuit 111 will be described in detail with reference to FIGS. 5 to 7.

In another embodiment, each of the pixel circuits 111 may include a first transistor including a first terminal connected to a first node, a gate terminal connected to a second node, and a second terminal connected to a third node; a second transistor including a first terminal connected to the data line Dk, a second terminal connected to the first node, and a gate terminal that receives the first gate signal GW; a third transistor including a first terminal connected to the third node, a second terminal connected to the second node, and a gate terminal that receives the second gate signal GC; a fourth transistor including a first terminal connected to the second node, a second terminal that receives a first initialization voltage, and a gate terminal that receives the initialization control signal GI; a fifth transistor including a first terminal that receives a first power voltage, a second terminal connected to the first node, and a gate terminal that receives the emission control signal EM; a sixth transistor including a first terminal connected to the third node, a second terminal connected to a fourth node, and a gate terminal that receives the emission control signal EM; a seventh transistor including a first terminal connected to the fourth node, a second terminal that receives a second initialization voltage, and a gate terminal that receives the bias control signal EB; an eighth transistor including a first terminal connected to the first node, a second terminal that receives a bias voltage, and a gate terminal that receives the bias control signal EB; a storage capacitor including a first terminal that receives the first power voltage and a second terminal connected to the second node; and a light emitting element including a first terminal connected to the fourth node and a second terminal that receives a second power voltage lower than the first power voltage. This embodiment of the pixel circuit 111 will be described in detail with reference to FIGS. 8 to 10.

The display panel 110 may be connected to the first scan driver 120 via the first scan lines S11~S1*n* and may be connected to the second scan driver 125 via the second scan lines S21~S2*n*. The first scan driver 120 may provide the bias control signal EB to the display panel 110 via the first scan lines S11~S1*n*. The second scan driver 125 may provide the first gate signal GW, the second gate signal GC, and the initialization control signal GI to the display panel 110 via the second scan lines S21~S2*n*. As illustrated in FIGS. 3 and 4, in a display-scan period DISPLAY SCAN in which the pixel circuits 111 perform the display-scan operation, the bias control signal EB that is applied via the first scan lines S11~S1*n* may include at least one turn-on voltage period, and the first gate signal GW, the second gate signal GC, and the initialization control signal GI that are applied via the second scan lines S21~S2*n* may include a turn-on voltage period. On the other hand, as illustrated in FIGS. 3 and 4, in a self-scan period SELF SCAN in which the pixel circuits 111 perform the self-scan operation, the bias control signal EB that is applied via the first scan lines S11~S1*n* may include at least one turn-on voltage period, but the first gate signal GW, the second gate signal GC, and the initialization control signal GI that are applied via the second scan lines S21~S2*n* may not include any turn-on voltage period. In other words, while the bias control signal EB includes at least one turn-on voltage period in both the display-scan period DISPLAY SCAN and the self-scan period SELF SCAN, the first gate signal GW, the second gate signal GC, and the initialization control signal GI may include at least one turn-on voltage period only in the display-scan period DISPLAY SCAN.

The bias control signal EB may be driven at a first frequency that is higher than the driving frequency of the display panel 110 (i.e., the frame rate of the panel driving frame). In an embodiment, the driving frequency of the display panel 110 may be set based on the first frequency, for example, as a factor of the first frequency. For example, the first frequency may be set to be two times or four times of a maximum driving frequency of the display panel 110. In a case where the maximum driving frequency of the display panel 110 is 120 Hz, the first frequency may be set to be 240 Hz or 480 Hz. Thus, in one panel driving frame, a scanning operation according to the bias control signal EB that is applied to the first scan lines S11~S1*n* may be repeated several times in a predetermined cycle. For example, the first scan driver 120 may perform the scanning operation once during the display-scan period DISPLAY SCAN at all driving frequencies of the display panel 110 and may perform the scanning operation at least once during the self-scan period SELF SCAN at driving frequencies other than the maximum driving frequency of the display panel 110. It is noted that the self-scan period SELF SCAN may not exist at the maximum driving frequency of the display panel 110.

On the other hand, the first gate signal GW, the second gate signal GC, and the initialization control signal GI may be driven at a second frequency that is equal to the driving frequency of the display panel 110 (i.e., the frame rate of the panel driving frame). The second frequency may be set based on the first frequency, for example, as a factor of the first frequency. In this case, in one panel driving frame, a scanning operation according to the first gate signal GW, the second gate signal GC, and the initialization control signal GI that are applied to the second scan lines S21~S2*n* may be performed once. For example, the second scan driver 125 may perform the scanning operation once during the display-scan period DISPLAY SCAN at all driving frequencies of the display panel 110 and may not perform the scanning operation during the self-scan period SELF SCAN.

The display panel 110 may be connected to the data driver 130 via data lines D1~Dm. The data driver 130 may provide the data signal DS (also referred to as a data voltage) to the display panel 110 via the data lines D1~Dm. Specifically, as illustrated in FIGS. 3 and 4, the data driver 130 may apply the data signal DS to the display panel 110 in the display-scan period DISPLAY SCAN and may not apply the data signal DS to the display panel 110 in the self-scan period SELF SCAN. The display panel 110 may be connected to the emission control driver 140 via emission control lines E1~En. The emission control driver 140 may provide the emission control signal EM to the display panel 110 via the emission control lines E1~En. As illustrated in FIGS. 3 and 4, in the display-scan period DISPLAY SCAN, the emission control signal EM that is applied via the emission control lines E1~En may include at least one turn-on voltage period. In addition, as illustrated in FIGS. 3 and 4, in the self-scan period SELF SCAN, the emission control signal EM that is applied via the emission control lines E1~En may include at least one turn-on voltage period. Accordingly, the emission control signal EM may be driven at the first frequency that is higher than the driving frequency of the display panel 110 (i.e., the frame rate of the panel driving frame). For example, the first frequency may be set to be two times or four times the maximum driving frequency of the display panel 110. In an example where the maximum driving frequency of the display panel 110 is 120 Hz, the first frequency may be set to be 240 Hz or 480 Hz. In this case, in one panel driving frame, a scanning operation according to the emission control signal EM that is applied to the emission control lines E1~En may be repeated several times in a predetermined cycle. For example, the emission control driver 140 may perform the scanning operation once during the display-scan period DISPLAY SCAN at all driving frequencies of the display panel 110 and may perform the scanning operation at least once during the self-scan period SELF SCAN at driving frequencies other than the maximum driving frequency of the display panel 110. It is noted that the self-scan period SELF SCAN may not exist at the maximum driving frequency of the display panel 110.

The timing controller 150 may generate a plurality of control signals CTL1, CTL2, CTL3, and CTL4 and provide the control signals CTL1, CTL2, CTL3, and CTL4 to the first scan driver 120, the second scan driver 125, the data driver 130, and the emission control driver 140, respectively. That is, the timing controller 150 may control the first scan driver 120, the second scan driver 125, the data driver 130, and the emission control driver 140 using the control signals CTL1, CTL2, CTL3, and CTL4. The timing controller 150 may receive image data DATA from an external component (e.g., a graphic processing unit (GPU) and the like) and may perform a data processing (e.g., luminance compensation and/or deterioration compensation) on the image data DATA to provide the processed image data DATA to the data driver 130.

The timing controller 150 may perform one display-scan period DISPLAY SCAN and at least one self-scan period SELF SCAN at a driving frequency (e.g., 120 Hz, 80 Hz, 60 Hz, 48 Hz, 30 Hz, 24 Hz) other than the maximum driving frequency of the display panel 110 (e.g., 240 Hz). In the example of FIG. 3, one panel driving frame 1F may include one display-scan period DISPLAY SCAN and one self-scan period SELF SCAN when the driving frequency of the display panel 110 is 120 Hz. In the example of FIG. 4, one panel driving frame 1F may include one display-scan period DISPLAY SCAN and two self-scan periods SELF SCAN when the driving frequency of the display panel 110 is 80 Hz. In other examples, one panel driving frame 1F may include one display-scan period DISPLAY SCAN and three self-scan periods SELF SCAN when the driving frequency of the display panel 110 is 60 Hz, and one panel driving frame 1F may include one display-scan period DISPLAY SCAN and four self-scan periods SELF SCAN when the driving frequency of the display panel 110 is 48 Hz. As described above, the timing controller 150 may respond to a change of the driving frequency of the display panel 110 (i.e., a change of the frame rate of the panel driving frame or a change of the driving time of the panel driving frame) by adjusting the number of the self-scan period SELF SCAN in one panel driving frame 1F.

Figure 5:
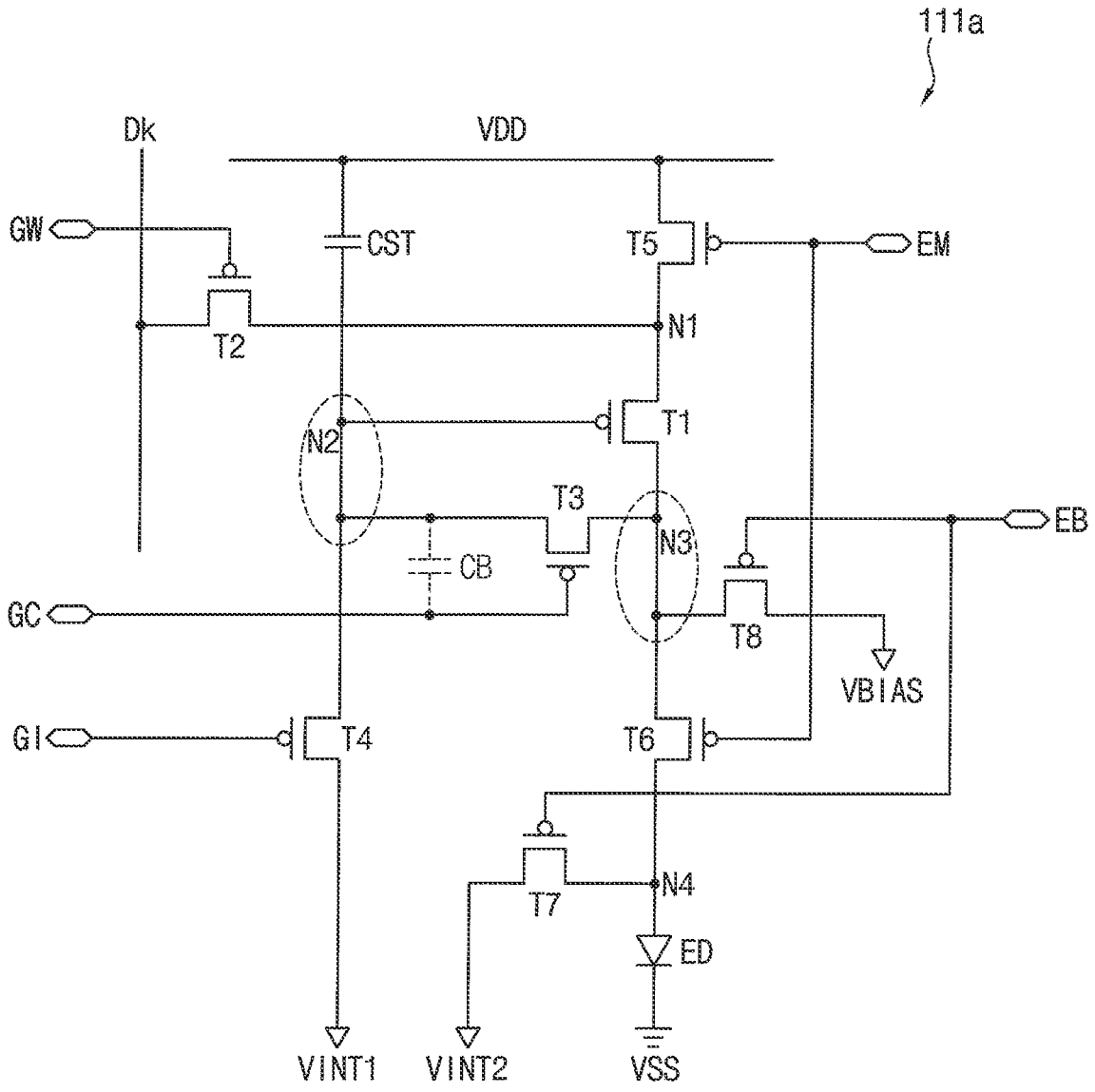
FIG. 5 is a circuit diagram illustrating an example of a pixel circuit included in the display device of FIG. 1.
Figure 6:
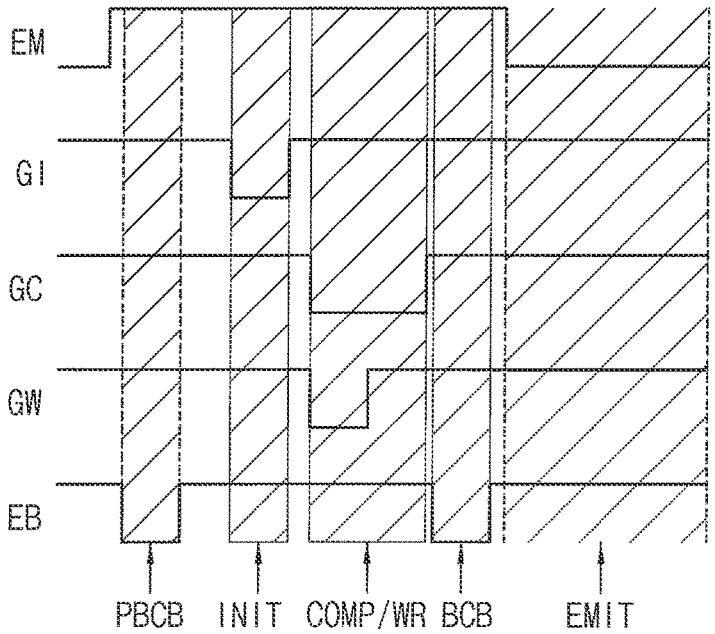
FIG. 6 is a timing diagram illustrating an example in which the pixel circuit of FIG. 5 performs a display-scan operation.
Figure 7:
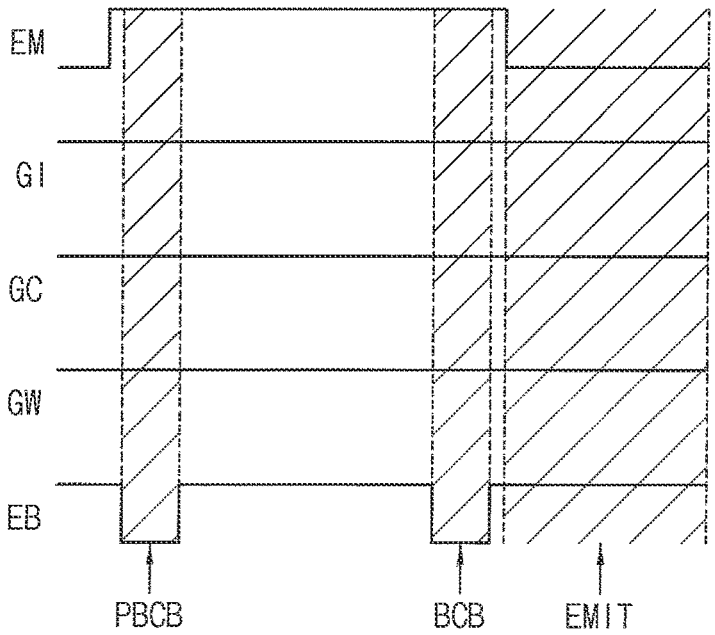
FIG. 7 is a timing diagram illustrating an example in which the pixel circuit of FIG. 5 performs a self-scan operation.

FIG. 5 is a circuit diagram illustrating an example of a pixel circuit PXL included in the display device 100 of FIG. 1, FIG. 6 is a timing diagram illustrating an example in which the pixel circuit PXL of FIG. 5 performs a display-scan operation, and FIG. 7 is a timing diagram illustrating an example in which the pixel circuit PXL of FIG. 5 performs a self-scan operation.

Referring to FIGS. 5 to 7, a pixel circuit 111*a*, as an example of the pixel circuits 111 shown in FIG. 1, may include a first transistor T1, a second transistor T2, a third transistor T3, a fourth transistor T4, a fifth transistor T5, a sixth transistor T6, a seventh transistor T7, an eighth transistor T8, a storage capacitor CST, and a light emitting element ED. In some embodiments, the pixel circuit 111*a* may further include a boost capacitor CB.

The first transistor T1 (also referred to as a driving transistor) may include a first terminal connected to a first node N1, a gate terminal connected to a second node N2, and a second terminal connected to a third node N3. The first transistor T1 may control a driving current flowing into the light emitting element ED corresponding to a voltage of the second node N2 (i.e., the data signal DS stored in the storage capacitor CST). The second transistor T2 (also referred to as a switching transistor) may include a first terminal connected to the data line Dk, a second terminal connected to the first node N1, and a gate terminal that receives the first gate signal GW. When the second transistor T2 is turned on in response to the first gate signal GW (i.e., in a turn-on voltage period of the first gate signal GW), the data signal DS that is applied via the data line Dk may be transferred to the first node N1. The third transistor T3 (also referred to as a compensation transistor) may include a first terminal connected to the third node N3, a second terminal connected to the second node N2, and a gate terminal that receives the second gate signal GC. When the third transistor T3 is turned on in response to the second gate signal GC (i.e., in a turn-on voltage period of the second gate signal GC), the second terminal (i.e., the third node N3) and the gate terminal (i.e., the second node N2) of the first transistor T1 may be electrically connected to each other. That is, when the third transistor T3 is turned on, the first transistor T1 may be diode-connected, and a threshold voltage of the first transistor T1 may be compensated. The fourth transistor T4 (also referred to as an initialization transistor) may include a first terminal connected to the second node N2, a second terminal that receives a first initialization voltage VINT1, and a gate terminal that receives the initialization control signal GI. When the fourth transistor T4 is turned on in response to the initialization control signal GI (i.e., in a turn-on voltage period of the initialization control signal GI), the first initialization voltage VINT1 may be transferred to the second node N2. That is, when the fourth transistor T4 is turned on, the second node N2 (i.e., the gate terminal of the first transistor T1) may be initialized with the first initialization voltage VINT1, and the first transistor T1 may be initialized to an on-bias state. Here, the first initialization voltage VINT1 may be lower than the voltage of the data signal DS applied via the data line Dk. Specifically, the data signal DS may be transferred to the first node N1 when the second transistor T2 is turned on, and the first transistor T1 may be turned on as the second node N2 is initialized with the first initialization voltage VINT1 that is lower than the voltage of the data signal DS. Thus, the data signal DS transferred to the first node N1 may be transferred to the second node N2 via the first transistor T1 that is diode-connected. Hence, a voltage corresponding to both the data signal DS and the threshold voltage of the first transistor T1 may be applied to the second node N2. As a result, the data signal DS compensated for the threshold voltage of the first transistor T1 may be stored in the storage capacitor CST. When the display panel 110 operates at a low driving frequency, a change in hysteresis of the first transistor T1 may become severe, resulting in a flicker in a case where the first initialization voltage VINT1 applied to the second node N2 is low. For this reason, the first initialization voltage VINT1 may be set to be higher than a second power voltage VSS.

The fifth transistor T5 (also referred to as an emission control transistor) may include a first terminal that receives a first power voltage VDD, a second terminal connected to the first node N1, and a gate terminal that receives the emission control signal EM. The sixth transistor T6 (also referred to as an emission control transistor) may include a first terminal connected to the third node N3, a second terminal connected to a fourth node N4, and a gate terminal that receives the emission control signal EM. When the fifth transistor T5 and sixth transistor T6 are turned on in response to the emission control signal EM (i.e., in a turn-on voltage period of the emission control signal EM), the light emitting element ED may emit light according to the driving current flowing into the light emitting element ED via the first transistor T1 between the first power voltage VDD and the second power voltage VSS. Although it is described above that the fifth transistor T5 and the sixth transistor T6 commonly receive the emission control signal EM to be simultaneously turned on or off, in some embodiments, the fifth transistor T5 and the sixth transistor T6 may receive respective emission control signals EM independently of each other.

The seventh transistor T7 (also referred to as a reset transistor) may include a first terminal connected to the fourth node N4, a second terminal that receives a second initialization voltage VINT2, and a gate terminal that receives the bias control signal EB. When the seventh transistor T7 is turned on in response to the bias control signal EB (i.e., in a turn-on voltage period of the bias control signal EB), the second initialization voltage VINT2 may be transferred to the fourth node N4. That is, when the seventh transistor T7 is turned on, the fourth node N4 to which the first terminal of the light emitting element ED is connected may be reset with the second initialization voltage VINT2. Specifically, when the second initialization voltage VINT2 is applied to the first terminal of the light emitting element ED (e.g., an anode of an organic light emitting diode), a parasitic capacitor of the light emitting element ED may be discharged, thereby preventing unintended micro-emission. As a result, an ability of the pixel circuit 111*a* for expressing black may be improved.

In an embodiment, the first initialization voltage VINT1 (i.e., an initialization voltage for initializing the second node N2) and the second initialization voltage VINT2 (i.e., an initialization voltage for initializing the fourth node N4) may be set differently to each other. In a case where the second initialization voltage VINT2 is higher than a specific reference, the parasitic capacitor of the light emitting element ED may be charged instead of being discharged. For this reason, the second initialization voltage VINT2 may be set to be lower than the second power voltage VSS. In some embodiments, the second initialization voltage VINT2 may be changed based on a driving time of the panel driving frame (i.e., the frame rate of the panel driving frame). By changing the second initialization voltage VINT2 according to an operating frequency of the display panel 110, the parasitic capacitor of the light emitting element ED may be efficiently discharged.

The eighth transistor T8 may include a first terminal connected to the third node N3, a second terminal that receives a bias voltage VBIAS, and a gate terminal that receives the bias control signal EB. When the eighth transistor T8 is turned on in response to the bias control signal EB (i.e., in a turn-on voltage period of the bias control signal EB), the bias voltage VBIAS may be applied to the third node N3, and a characteristics-curve of the first transistor T1 may be changed as a voltage of the third node N3 is changed to the bias voltage VBIAS. Thus, a luminance change due to hysteresis of the first transistor T1 may be improved or prevented. For example, the bias voltage VBIAS may be set to be a specific voltage (i.e., a DC voltage) within a voltage range of the data signal DS or a gate-on voltage VGH of the first gate signal GW. In some embodiments, the bias voltage VBIAS may be changed based on a driving time of the panel driving frame (i.e., the frame rate of the panel driving frame). By changing the bias voltage VBIAS according to an operating frequency of the display panel 110, the luminance change due to hysteresis of the first transistor T1 may be efficiently improved or prevented.

The storage capacitor CST may include a first terminal that receives the first power voltage VDD and a second terminal connected to the second node N2. As described above, when the second transistor T2 and the third transistor T3 are turned on, the data signal DS transferred to the first node N1 is transferred to the second node N2 via the first transistor T1 when it is diode-connected by the third transistor T3, and the storage capacitor CST may store the data signal DS compensated for the threshold voltage of the first transistor T1.

The light emitting element ED may include a first terminal connected to the fourth node N4 and a second terminal that receives the second power voltage VSS lower than the first power voltage VDD. As described above, the light emitting element ED may emit light having a specific luminance based on the driving current supplied by the first transistor T1. In an embodiment, the light emitting element ED may be an organic light emitting diode including an organic light emitting layer. In another embodiment, the light emitting element ED may be an inorganic light emitting element (e.g., quantum-dot) formed of an inorganic material. In some embodiments, a plurality of light emitting elements ED may be connected in parallel and/or in serial between the second power voltage VSS and the fourth node N4. The boost capacitor CB may include a first terminal connected to the second node N2 and a second terminal connected to the gate terminal of the third transistor T3. The boost capacitor CB may be optional to boost a voltage of the second node N2.

In an embodiment, the pixel circuit 111*a* may perform one display-scan operation when the driving time of the panel driving frame is the minimum driving time (i.e., when a driving frequency of the display panel 110 is a maximum driving frequency) and may perform one display-scan operation and at least one self-scan operation when the driving time of the panel driving frame is not the minimum driving time (i.e., when the driving frequency of the display panel 110 is lower than the maximum driving frequency). As described above, the display-scan operation may be an operation that receives the data signal DS to emit light using the light emitting element ED, and the self-scan operation may be an operation that changes characteristics of the first transistor T1 (i.e., the driving transistor).

Referring to FIG. 6, when the pixel circuit 111*a* performs the display-scan operation, each of the first gate signal GW, the second gate signal GC, the initialization control signal GI, the bias control signal EB, and the emission control signal EM may include at least one turn-on voltage period (e.g., a logic low period). In an embodiment, the turn-on voltage period of the initialization control signal GI, the turn-on voltage period of the first gate signal GW, the turn-on voltage period of the second gate signal GC, and the turn-on voltage period of the bias control signal EB may be positioned in a turn-off voltage period of the emission control signal EM. For example, as illustrated in FIG. 6, the bias control signal EB may have two turn-on voltage periods (i.e., a first turn-on voltage period and a second turn-on voltage period) in the turn-off voltage period of the emission control signal EM. In this case, the first turn-on voltage period of the bias control signal EB may be positioned before the turn-on voltage period of the initialization control signal GI, and the second turn-on voltage period of the bias control signal EB may be positioned after the turn-on voltage period of the second gate signal GC. In another embodiment, the bias control signal EB may have one turn-on voltage period in the turn-off voltage period of the emission control signal EM. In this case, the bias control signal EB may omit the first turn-on voltage period and may have only the second turn-on voltage period after the turn-on voltage period of the second gate signal GC.

Specifically, a reset-bias operation PBCB may be performed in the first turn-on voltage period of the bias control signal EB. That is, in the first turn-on voltage period of the bias control signal EB, the second initialization voltage VINT2 may be applied to the fourth node N4 as the seventh transistor T7 is turned on, and the bias voltage VBIAS may be applied to the third node N3 as the eighth transistor T8 is turned on. Subsequently, an initializing operation INIT may be performed in the turn-on voltage period of the initialization control signal GI. In the turn-on voltage period of the initialization control signal GI, the first initialization voltage VINT1 may be applied to the second node N2 as the fourth transistor T4 is turned on. Next, a threshold voltage compensating operation COMP and a data writing operation WR may be performed in the turn-on voltage period of the first gate signal GW and the turn-on voltage period of the second gate signal GC. In the turn-on voltage period of the first gate signal GW and the turn-on voltage period of the second gate signal GC, the data signal DS compensated for the threshold voltage of the first transistor T1 may be stored in the storage capacitor CST as the first transistor T1, the second transistor T2, and the third transistor T3 are turned on. Here, the turn-on voltage period of the second gate signal GC may be longer than the turn-on voltage period of the first gate signal GW, and a portion of the turn-on voltage period of the second gate signal GC may overlap the turn-off voltage period of the first gate signal GW. Subsequently, a reset-bias operation BCB may be performed in the second turn-on voltage period of the bias control signal EB. In the second turn-on voltage period of the bias control signal EB, the second initialization voltage VINT2 may be applied to the fourth node N4 as the seventh transistor T7 is turned on, and the bias voltage VBIAS may be applied to the third node N3 as the eighth transistor T8 is turned on. Next, a light emitting operation EMIT may be performed in the turn-on voltage period of the emission control signal EM. In the turn-on voltage period of the emission control signal EM, a driving current may flow into the light emitting element ED, and the light emitting element ED may emit light according to the driving current as the fifth transistor T5 and the sixth transistor T6 are turned on.

Referring to FIG. 7, when the pixel circuit 111*a* performs the self-scan operation, each of the bias control signal EB and the emission control signal EM may include at least one turn-on voltage period (e.g., a logic low period), and each of the first gate signal GW, the second gate signal GC, and the initialization control signal GI may not include the turn-on voltage period. In other words, when the pixel circuit 111*a* performs the self-scan operation, each of the first gate signal GW, the second gate signal GC, and the initialization control signal GI may include only a turn-off voltage period (e.g., a logic high period). In an embodiment, the turn-on voltage period of the bias control signal EB may be positioned in the turn-off voltage period of the emission control signal EM. For example, as illustrated in FIG. 7, the bias control signal EB may have two turn-on voltage periods (i.e., a first turn-on voltage period corresponding to the reset-bias operation PBCB and a second turn-on voltage period corresponding to the reset-bias operation BCB) that are temporally spaced apart in the turn-off voltage period of the emission control signal EM. In another embodiment, the bias control signal EB may have one turn-on voltage period in the turn-off voltage period of the emission control signal EM. In this case, the turn-on voltage period of the bias control signal EB may be positioned immediately before the turn-on voltage period of the emission control signal EM. Specifically, the reset-bias operation BCB may be performed in the turn-off voltage period of the emission control signal EM and the turn-on voltage period of the bias control signal EB. That is, in a state in which the driving current does not flow into the light emitting element ED as the fifth transistor T5 and the sixth transistor T6 are turned off, the second initialization voltage VINT2 may be applied to the fourth node N4 as the seventh transistor T7 is turned on, and the bias voltage VBIAS may be applied to the third node N3 as the eighth transistor T8 is turned on. Subsequently, the light emitting operation EMIT may be performed in the turn-on voltage period of the emission control signal EM. In the turn-on voltage period of the emission control signal EM, the driving current may flow into the light emitting element ED, and the light emitting element ED may emit light according to the driving current as the fifth transistor T5 and the sixth transistor T6 are turned on.

The pixel circuit 111*a* may prevent a phenomenon such as a flicker that may occur on the display panel 110 due to hysteresis characteristics of the driving transistor (i.e., the first transistor T1) that may be fixed in a specific state during the panel driving frame by performing one display-scan operation when the driving time of the panel driving frame is the minimum driving time, and by performing one display-scan operation and at least one self-scan operation when the driving time of the panel driving frame is not the minimum driving time. As a result, the display device 100 including the pixel circuit 111*a* may provide a high-quality image to a viewer even when the display panel 110 operates at a low driving frequency.

Figure 8:
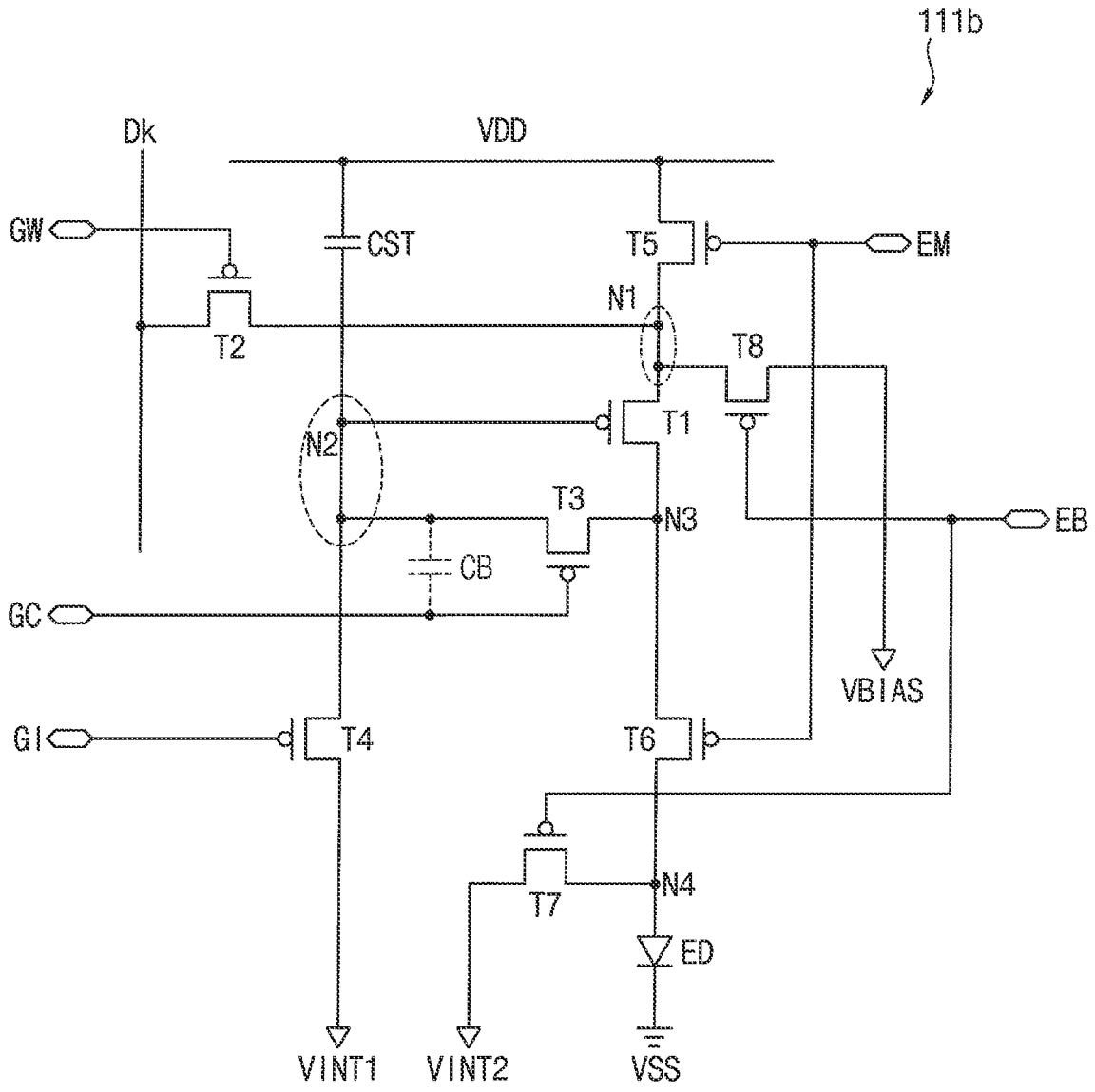
FIG. 8 is a circuit diagram illustrating another example of a pixel circuit included in the display device of FIG. 1.
Figure 9:
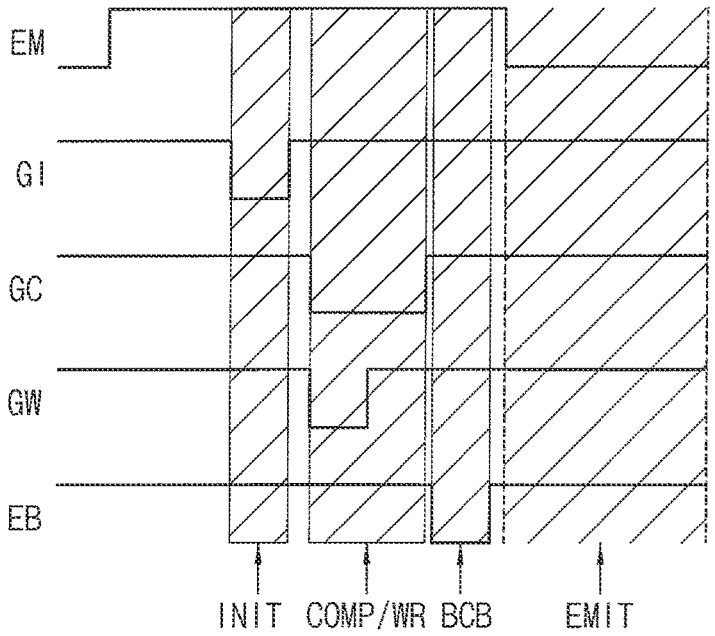
FIG. 9 is a timing diagram illustrating an example in which the pixel circuit of FIG. 8 performs a display-scan operation.
Figure 10:
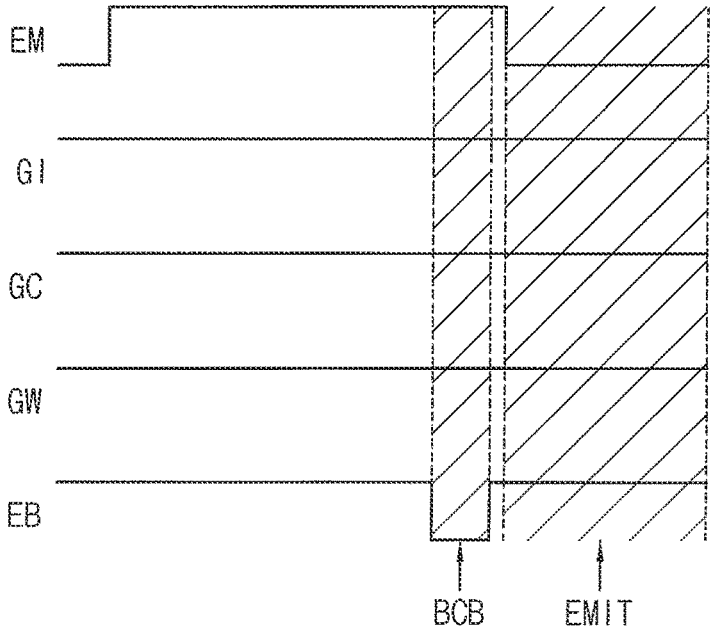
FIG. 10 is a timing diagram illustrating an example in which the pixel circuit of FIG. 8 performs a self-scan operation.

FIG. 8 is a circuit diagram illustrating another example of a pixel circuit included in the display device 100 of FIG. 1, FIG. 9 is a timing diagram illustrating an example in which the pixel circuit of FIG. 8 performs a display-scan operation, and FIG. 10 is a timing diagram illustrating an example in which the pixel circuit of FIG. 8 performs a self-scan operation.

Referring to FIGS. 8 to 10, a pixel circuit 111*b* may include a first transistor T1, a second transistor T2, a third transistor T3, a fourth transistor T4, a fifth transistor T5, a sixth transistor T6, a seventh transistor T7, an eighth transistor T8, a storage capacitor CST, and a light emitting element ED. In some embodiments, the pixel circuit 111*b* may further include a boost capacitor CB. Except for a connection structure of the eighth transistor T8, the pixel circuit 111*b* of FIG. 8 may be substantially the same as the pixel circuit 111*a* of FIG. 5. Thus, duplicated description therebetween will not be repeated.

The eighth transistor T8 may include a first terminal connected to the first node N1, a second terminal that receives the bias voltage VBIAS, and a gate terminal that receives the bias control signal EB. When the eighth transistor T8 is turned on in response to the bias control signal EB (i.e., in a turn-on voltage period of the bias control signal EB), the bias voltage VBIAS may be applied to the first node N1, and a characteristics-curve of the first transistor T1 may be changed as a voltage of the first node N1 is changed to the bias voltage VBIAS. Thus, a luminance change due to hysteresis of the first transistor T1 may be improved or prevented. For example, the bias voltage VBIAS may be set to be a specific voltage (i.e., a DC voltage) within a voltage range of the data signal DS or a gate-on voltage VGH of the first gate signal GW. In some embodiments, the bias voltage VBIAS may be changed based on a driving time of the panel driving frame (i.e., the frame rate of the panel driving frame). By changing the bias voltage VBIAS according to an operating frequency of the display panel 110, the luminance change due to hysteresis of the first transistor T1 may be efficiently improved or prevented.

In an embodiment, the pixel circuit 111*b* may perform one display-scan operation when the driving time of the panel driving frame is the minimum driving time (i.e., when the driving frequency of the display panel 110 is the maximum driving frequency) and may perform one display-scan operation and at least one self-scan operation when the driving time of the panel driving frame is not the minimum driving time (i.e., when the driving frequency of the display panel 110 is lower than the maximum driving frequency).

Referring to FIG. 9, when the pixel circuit 111*b* performs the display-scan operation, each of the first gate signal GW, the second gate signal GC, the initialization control signal GI, the bias control signal EB, and the emission control signal EM may include at least one turn-on voltage period (e.g., a logic low period). In an embodiment, the turn-on voltage period of the initialization control signal GI, the turn-on voltage period of the first gate signal GW, the turn-on voltage period of the second gate signal GC, and the turn-on voltage period of the bias control signal EB may be positioned in the turn-off voltage period of the emission control signal EM. For example, the bias control signal EB may include two turn-on voltage periods (i.e., the first turn-on voltage period and the second turn-on voltage period) in the turn-off voltage period of the emission control signal EM. In this case, the first turn-on voltage period of the bias control signal EB may be positioned before the turn-on voltage period of the initialization control signal GI, and the second turn-on voltage period of the bias control signal EB may be positioned after the turn-on voltage period of the second gate signal GC. In another embodiment, as illustrated in FIG. 9, the bias control signal EB may include one turn-on voltage period in the turn-off voltage period of the emission control signal EM. In this case, the turn-on voltage period of the bias control signal EB may be positioned after the turn-on voltage period of the second gate signal GC.

Specifically, the initializing operation INIT may be performed in the turn-on voltage period of the initialization control signal GI. In the turn-on voltage period of the initialization control signal GI, the first initialization voltage VINT1 may be applied to the second node N2 as the fourth transistor T4 is turned on. Next, the threshold voltage compensating operation COMP and the data writing operation WR may be performed in the turn-on voltage period of the first gate signal GW and the turn-on voltage period of the second gate signal GC. In the turn-on voltage period of the first gate signal GW and the turn-on voltage period of the second gate signal GC, the data signal DS compensated for the threshold voltage of the first transistor T1 may be stored in the storage capacitor CST as the first transistor T1, the second transistor T2, and the third transistor T3 are turned on. Here, the turn-on voltage period of the second gate signal GC may be longer than the turn-on voltage period of the first gate signal GW, and a portion of the turn-on voltage period of the second gate signal GC may overlap the turn-off voltage period of the first gate signal GW. Subsequently, the reset-bias operation BCB may be performed in the turn-on voltage period of the bias control signal EB. In the turn-on voltage period of the bias control signal EB, the second initialization voltage VINT2 may be applied to the fourth node N4 as the seventh transistor T7 is turned on, and the bias voltage VBIAS may be applied to the first node N1 as the eighth transistor T8 is turned on. Next, the light emitting operation EMIT may be performed in the turn-on voltage period of the emission control signal EM. In the turn-on voltage period of the emission control signal EM, a driving current may flow into the light emitting element ED, and the light emitting element ED may emit light according to the driving current as the fifth transistor T5 and the sixth transistor T6 are turned on.

Referring to FIG. 10, when the pixel circuit 111*b* performs the self-scan operation, each of the bias control signal EB and the emission control signal EM may include at least one turn-on voltage period (e.g., a logic low period), and each of the first gate signal GW, the second gate signal GC, and the initialization control signal GI may not include the turn-on voltage period. In other words, when the pixel circuit 111*b* performs the self-scan operation, each of the first gate signal GW, the second gate signal GC, and the initialization control signal GI may include only a turn-off voltage period (e.g., a logic high period). In an embodiment, the turn-on voltage period of the bias control signal EB may be positioned in the turn-off voltage period of the emission control signal EM. For example, the bias control signal EB may have two turn-on voltage periods (i.e., a first turn-on voltage period and a second turn-on voltage period) that are temporally spaced apart in the turn-off voltage period of the emission control signal EM. In another embodiment, as illustrated in FIG. 10, the bias control signal EB may have one turn-on voltage period in the turn-off voltage period of the emission control signal EM. In this case, the turn-on voltage period of the bias control signal EB may be positioned immediately before the turn-on voltage period of the emission control signal EM. Specifically, the reset-bias operation BCB may be performed in the turn-off voltage period of the emission control signal EM and the turn-on voltage period of the bias control signal EB. That is, in a state in which the driving current does not flow into the light emitting element ED as the fifth transistor T5 and the sixth transistor T6 are turned off, the second initialization voltage VINT2 may be applied to the fourth node N4 as the seventh transistor T7 is turned on, and the bias voltage VBIAS may be applied to the first node N1 as the eighth transistor T8 is turned on. Subsequently, the light emitting operation EMIT may be performed in the turn-on voltage period of the emission control signal EM. In the turn-on voltage period of the emission control signal EM, the driving current may flow into the light emitting element ED, and the light emitting element ED may emit light according to the driving current as the fifth transistor T5 and the sixth transistor T6 are turned on.

In brief, the pixel circuit 111*b* may prevent a phenomenon such as a flicker that may occur on the display panel 110 due to hysteresis characteristics of the driving transistor (i.e., the first transistor T1) that may be fixed in a specific state during the panel driving frame by performing one display-scan operation when the driving time of the panel driving frame is the minimum driving time, and by performing one display-scan operation and at least one self-scan operation when the driving time of the panel driving frame is not the minimum driving time. As a result, the display device 100 including the pixel circuit 111*b* may provide a high-quality image to a viewer even when the display panel 110 operates at a low driving frequency.

Figure 11:
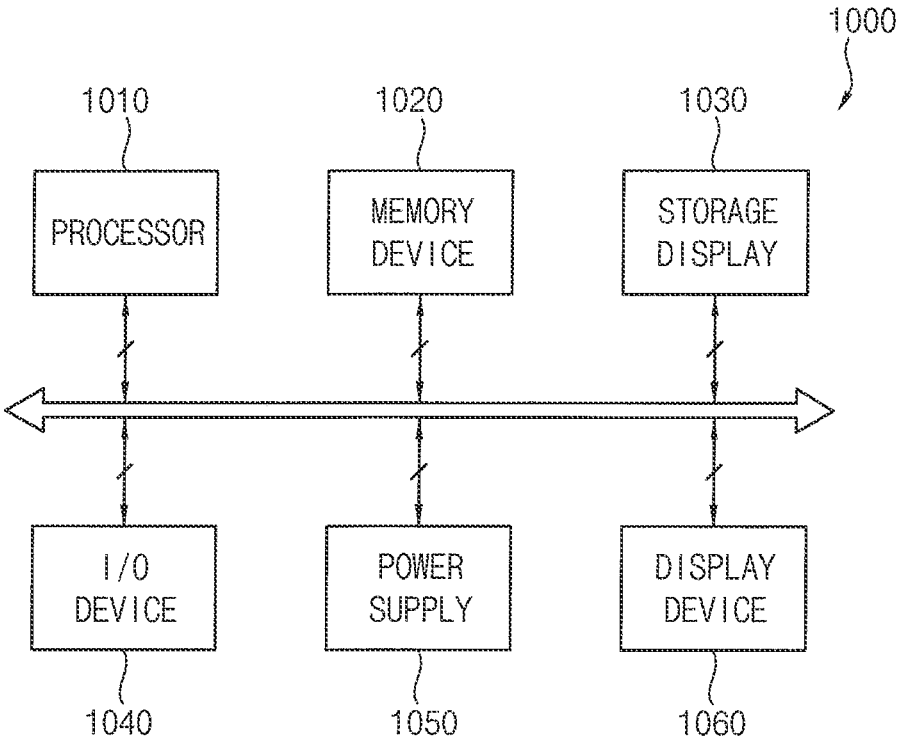
FIG. 11 is a block diagram of an electronic device according to an embodiment.
Figure 12:
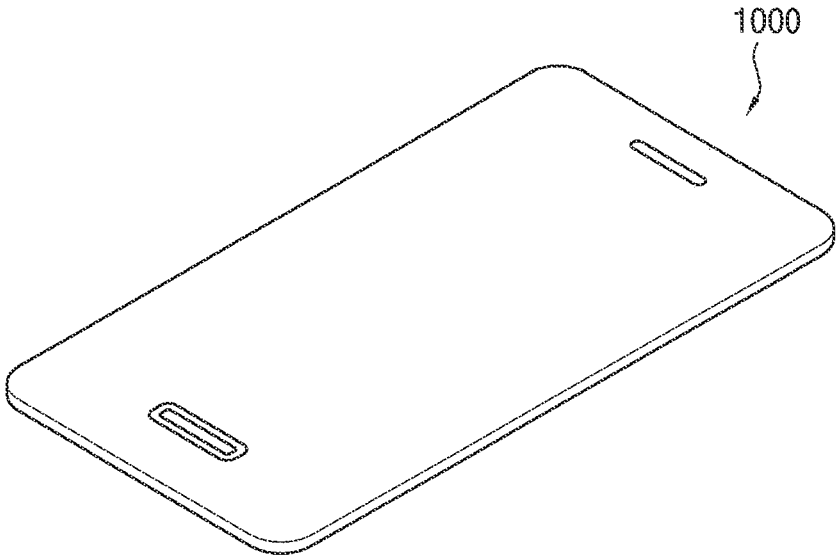
FIG. 12 illustrates an example of the electronic device of FIG. 11 implemented as a smart phone.

FIG. 11 is a block diagram of an electronic device according to an embodiment, and FIG. 12 illustrates an example of the electronic device of FIG. 11 implemented as a smart phone.

Referring to FIGS. 11 and 12, an electronic device 1000 may include a processor 1010, a memory device 1020, a storage device 1030, an input/output (I/O) device 1040, a power supply 1050, and a display device 1060. The display device 1060 may be the display device 100 of FIG. 1. In addition, the electronic device 1000 may further include a plurality of ports for communicating with a video card, a sound card, a memory card, a universal serial bus (USB) device, other electronic devices, etc. As illustrated in FIG. 12, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop computer, a head mounted display (HMD) device, or the like.

The processor 1010 may perform various computing tasks. The processor 1010 may be a micro-processor, a central processing unit (CPU), an application processor (AP), or the like. The processor 1010 may be coupled to other components via an address bus, a control bus, a data bus, etc. Further, the processor 1010 may be coupled to an extended bus such as a peripheral component interconnection (PCI) bus. The memory device 1020 may store data of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, or the like and/or at least one volatile memory device such as a dynamic random access memory (DRAM) device, a static random access memory (SRAM) device, a mobile DRAM device, or the like. The storage device 1030 may include a solid state drive (SSD) device, a hard disk drive (HDD) device, a CD-ROM device, or the like. The I/O device 1040 may include an input device such as a keyboard, a keypad, a mouse device, a touch-pad, a touch-screen, or the like and an output device such as a printer, a speaker, or the like. In some embodiments, the display device 1060 may be included as the I/O device 1040. The power supply 1050 may provide power for operating the electronic device 1000. The display device 1060 may be coupled to other components via the buses or other communication links.

The display device 1060 may display an image corresponding to visual information of the electronic device 1000. Examples of the display device 1060 include, but are not limited to, an organic light emitting display device and a quantum-dot light emitting display device. However, the display device 1060 is not limited to these examples. The display device 1060 may include a display panel (e.g., the display panel 110 of FIG. 1) including a pixel circuit (e.g., the pixel circuit 111*a* of FIG. 5 and the pixel circuit 111*b* of FIG. 8) that can prevent a phenomenon such as a flicker that may occur on the display panel due to hysteresis characteristics of a driving transistor that may be fixed in a specific state during a panel driving frame by performing one display-scan operation when a driving time of the panel driving frame is a minimum driving time and by performing one display-scan operation and at least one self-scan operation when the driving time of the panel driving frame is not the minimum driving time. Thus, the display device 1060 may provide a high-quality image to a viewer even when the display panel operates at a low driving frequency. Since the pixel circuit is described above, duplicated description related thereto will not be repeated.

The present inventive concept may be applied to a display device and an electronic device including the display device. For example, the present inventive concept may be applied to a smart phone, a cellular phone, a video phone, a smart pad, a smart watch, a tablet PC, a car navigation system, a television, a computer monitor, a laptop, a digital camera, a head mounted display (HMD) device, or the like.

The foregoing is illustrative of the example embodiments of the present disclosure and is not to be construed as limiting thereof. Although some embodiments have been described, those skilled in the art will readily appreciate that many modifications are possible in the disclosed embodiments without materially departing from the novel teachings and advantages of the present inventive concept. Accordingly, such modifications are intended to be included within the scope of the present disclosure. Therefore, it is to be understood that the foregoing is illustrative of various embodiments of the present disclosure and is not to be construed as limited to the specific embodiments disclosed, and that modifications to the disclosed embodiments, as well as other embodiments, are intended to be included within the scope of the present disclosure including the appended claims.

What is claimed is:

1. A pixel circuit comprising:

a first transistor including a first terminal connected to a first node, a gate terminal connected to a second node, and a second terminal connected to a third node;

a second transistor including a first terminal connected to a data line, a second terminal connected to the first node, and a gate terminal that receives a first gate signal;

a third transistor including a first terminal connected to the third node, a second terminal connected to the second node, and a gate terminal that receives a second gate signal;

a fourth transistor including a first terminal connected to the second node, a second terminal that receives a first initialization voltage, and a gate terminal that receives an initialization control signal;

a fifth transistor including a first terminal that receives a first power voltage, a second terminal connected to the first node, and a gate terminal that receives an emission control signal;

a sixth transistor including a first terminal connected to the third node, a second terminal connected to a fourth node, and a gate terminal that receives the emission control signal;

a seventh transistor including a first terminal connected to the fourth node, a second terminal that receives a second initialization voltage, and a gate terminal that receives a bias control signal;

an eighth transistor including a first terminal connected to the third node, a second terminal that receives a bias voltage, and a gate terminal that receives the bias control signal;

a storage capacitor including a first terminal that receives the first power voltage and a second terminal connected to the second node; and a light emitting element including a first terminal connected to the fourth node and a second terminal that receives a second power voltage lower than the first power voltage, wherein the pixel circuit performs a display-scan operation in a first case where a driving time of a panel driving frame is a minimum driving time, and the pixel circuit performs a display-scan operation and at least one self-scan operation in a second case where the driving time of the panel driving frame is different from the minimum driving time.

2. The pixel circuit of claim 1, wherein, when the pixel circuit performs the display-scan operation, each of the first gate signal, the second gate signal, the initialization control signal, the bias control signal, and the emission control signal includes at least one turn-on voltage period.

3. The pixel circuit of claim 2, wherein the at least one turn-on voltage period of the initialization control signal, the at least one turn-on voltage period of the first gate signal, the at least one turn-on voltage period of the second gate signal, and the at least one turn-on voltage period of the bias control signal are positioned in a turn-off voltage period of the emission control signal.

4. The pixel circuit of claim 3, wherein the at least one turn-on voltage period of the bias control signal is positioned after the at least one turn-on voltage period of the second gate signal.

5. The pixel circuit of claim 3, wherein the at least one turn-on voltage period of the bias control signal includes a first turn-on voltage period positioned before the at least one turn-on voltage period of the initialization control signal and a second turn-on voltage period positioned after the at least one turn-on voltage period of the second gate signal.

6. The pixel circuit of claim 1, wherein, when the pixel circuit performs the self-scan operation, each of the bias control signal and the emission control signal includes at least one turn-on voltage period, and each of the first gate signal, the second gate signal, and the initialization control signal is turned off.

7. The pixel circuit of claim 6, wherein the at least one turn-on voltage period of the bias control signal is positioned in a turn-off voltage period of the emission control signal.

8. The pixel circuit of claim 6, wherein the at least one turn-on voltage period of the bias control signal includes a first turn-on voltage period and a second turn-on voltage period that are temporally spaced apart from each other in a turn-off voltage period of the emission control signal.

9. The pixel circuit of claim 1, wherein the bias voltage and the second initialization voltage are changed based on the driving time of the panel driving frame.

10. The pixel circuit of claim 1, further comprising:

a boost capacitor including a first terminal connected to the second node and a second terminal connected to the gate terminal of the third transistor.

11. A pixel circuit comprising:

a first transistor including a first terminal connected to a first node, a gate terminal connected to a second node, and a second terminal connected to a third node;

a second transistor including a first terminal connected to a data line, a second terminal connected to the first node, and a gate terminal that receives a first gate signal;

a third transistor including a first terminal connected to the third node, a second terminal connected to the second node, and a gate terminal that receives a second gate signal;

a fourth transistor including a first terminal connected to the second node, a second terminal that receives a first initialization voltage, and a gate terminal that receives an initialization control signal;

a fifth transistor including a first terminal that receives a first power voltage, a second terminal connected to the first node, and a gate terminal that receives an emission control signal;

a sixth transistor including a first terminal connected to the third node, a second terminal connected to a fourth node, and a gate terminal that receives the emission control signal;

a seventh transistor including a first terminal connected to the fourth node, a second terminal that receives a second initialization voltage, and a gate terminal that receives a bias control signal;

an eighth transistor including a first terminal connected to the first node, a second terminal that receives a bias voltage, and a gate terminal that receives the bias control signal;

a storage capacitor including a first terminal that receives the first power voltage and a second terminal connected to the second node; and a light emitting element including a first terminal connected to the fourth node and a second terminal that receives a second power voltage lower than the first power voltage, wherein the pixel circuit performs a display-scan operation in a first case where a driving time of a panel driving frame is a minimum driving time, and the pixel circuit performs a display-scan operation and at least one self-scan operation in a second case where the driving time of the panel driving frame is different from the minimum driving time.

12. The pixel circuit of claim 11, wherein, when the pixel circuit performs the display-scan operation, each of the first gate signal, the second gate signal, the initialization control signal, the bias control signal, and the emission control signal includes at least one turn-on voltage period.

13. The pixel circuit of claim 12, wherein the at least one turn-on voltage period of the initialization control signal, the at least one turn-on voltage period of the first gate signal, the at least one turn-on voltage period of the second gate signal, and the at least one turn-on voltage period of the bias control signal are positioned in a turn-off voltage period of the emission control signal.

14. The pixel circuit of claim 13, wherein the at least one turn-on voltage period of the bias control signal is positioned after the at least one turn-on voltage period of the second gate signal.

15. The pixel circuit of claim 13, wherein the at least one turn-on voltage period of the bias control signal includes a first turn-on voltage period positioned before the at least one turn-on voltage period of the initialization control signal and a second turn-on voltage period positioned after the at least one turn-on voltage period of the second gate signal.

16. The pixel circuit of claim 11, wherein, when the pixel circuit performs the self-scan operation, each of the bias control signal and the emission control signal includes at least one turn-on voltage period, and each of the first gate signal, the second gate signal, and the initialization control signal is turned off.

17. The pixel circuit of claim 16, wherein the at least one turn-on voltage period of the bias control signal is positioned in a turn-off voltage period of the emission control signal.

18. The pixel circuit of claim 16, wherein the at least one turn-on voltage period of the bias control signal includes a first turn-on voltage period and a second turn-on voltage period that are temporally spaced apart from each other in a turn-off voltage period of the emission control signal.

19. The pixel circuit of claim 11, wherein the bias voltage and the second initialization voltage are changed based on the driving time of the panel driving frame.

20. The pixel circuit of claim 11, further comprising:

a boost capacitor including a first terminal connected to the second node and a second terminal connected to the gate terminal of the third transistor.

* * * * *